US011841011B2

(12) United States Patent
Li et al.

(10) Patent No.: US 11,841,011 B2
(45) Date of Patent: Dec. 12, 2023

(54) CONTROL METHOD OF COMPRESSOR AND REFRIGERANT CIRCULATION SYSTEM

(71) Applicant: Gree Electric Appliances, Inc. of Zhuhai, Guangdong (CN)

(72) Inventors: Yang Li, Guangdong (CN); Xiaolin He, Guangdong (CN); Wenbin Liu, Guangdong (CN); Xiaona Zheng, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 315 days.

(21) Appl. No.: 17/260,269

(22) PCT Filed: Dec. 20, 2018

(86) PCT No.: PCT/CN2018/122218

§ 371 (c)(1),
(2) Date: Jan. 14, 2021

(87) PCT Pub. No.: WO2020/029508

PCT Pub. Date: Feb. 13, 2020

(65) Prior Publication Data

US 2021/0301812 A1 Sep. 30, 2021

(30) Foreign Application Priority Data

Aug. 6, 2018 (CN) ..... 201810883844.3

(51) Int. Cl.
*F04B 49/06* (2006.01)
*F04B 27/00* (2006.01)
(Continued)

(52) U.S. Cl.
CPC ..... *F04B 49/06* (2013.01); *F04B 25/00* (2013.01); *F04B 27/005* (2013.01); *F04B 49/02* (2013.01);
(Continued)

(58) Field of Classification Search
CPC ..... F04B 49/065; F04B 49/02; F04B 25/00; F04B 49/225; F04B 49/06; F04B 49/10;
(Continued)

(56) References Cited

U.S. PATENT DOCUMENTS 5,600,961 A 2/1997 Whipple, III
6,123,510 A 9/2000 Greer et al.
(Continued)

FOREIGN PATENT DOCUMENTS

CN 103062866 A 4/2013
CN 104654516 A 5/2015
(Continued)

*Primary Examiner* — Peter J Bertheaud
(74) *Attorney, Agent, or Firm* — The Webb Law Firm

(57) ABSTRACT

The present disclosure provides a control method of a compressor and a refrigerant circulation system. The control method includes deciding whether a current working volume state of the compressor is matched with a control instruction after the compressor completes a change to a working volume according to the control instruction; determining that the compressor operates normally in a case where the current working volume state of the compressor is matched with the control instruction; and determining that the compressor operates in fault in a case where the current working volume state of the compressor is not matched with the control instruction.

20 Claims, 2 Drawing Sheets

(51) Int. Cl.

| | |
|---|---|
| ***F04B 49/03*** | (2006.01) |
| ***F04B 49/02*** | (2006.01) |
| ***F04B 49/22*** | (2006.01) |
| ***F04B 25/00*** | (2006.01) |
| ***F04B 51/00*** | (2006.01) |
| ***F04B 49/10*** | (2006.01) |
| ***F25B 1/10*** | (2006.01) |
| ***F15B 19/00*** | (2006.01) |

(52) U.S. Cl.
CPC ..... *F04B 49/03* (2013.01); *F04B 49/065* (2013.01); *F04B 49/10* (2013.01); *F04B 49/225* (2013.01); *F04B 51/00* (2013.01); *F15B 19/005* (2013.01); *F25B 1/10* (2013.01); *F04B 2201/0807* (2013.01); *F04B 2201/0808* (2013.01); *F04B 2207/703* (2013.01); *F25B 2400/074* (2013.01)

(58) Field of Classification Search
CPC ..... F04B 51/00; F04B 27/005; F04B 49/03; F04B 2201/0807; F04B 2201/0808; F04B 2207/703; F15B 19/005; F25B 2400/074; F25B 1/10
See application file for complete search history.

(56) References Cited

U.S. PATENT DOCUMENTS

| | | | | |
|---|---|---|---|---|
| 9,677,556 | B2 * | 6/2017 | Worden | F04B 51/00 |
| 2005/0034469 | A1 | 2/2005 | Ochiai | |

FOREIGN PATENT DOCUMENTS

| | | | |
|---|---|---|---|
| CN | 104729138 | A | 6/2015 |
| CN | 104729172 | A | 6/2015 |
| CN | 106403349 | A | 2/2017 |
| EP | 2629025 | A1 | 8/2013 |
| KR | 1020080059910 | A | 7/2008 |

* cited by examiner

CONTROL METHOD OF COMPRESSOR AND REFRIGERANT CIRCULATION SYSTEM

CROSS-REFERENCE TO RELATED APPLICATIONS

The present disclosure is a U.S. National Stage Application under 35 U.S.C. § 371 of International Patent Application No. PCT/CN2018/122218, filed on Dec. 20, 2018, which is based on and claims priority of Chinese application for invention No. 201810883844.3, filed on Aug. 6, 2018, the disclosures of both of which are hereby incorporated into this disclosure by reference in their entirety.

BACKGROUND OF THE INVENTION

Field of the Invention

This disclosure relates to the technical field of intelligent control, and particularly to a control method of a compressor and a refrigerant circulation system.

Description of Related Art

In order to improve the energy efficiency of an air conditioning unit in a low-load state, and reduce the minimum refrigerating capacity while improving the energy efficiency, a conventional air conditioning unit operates by using a compressor with a variable working volume, so as to switch to different working volumes according to different operation capacities of the air conditioning unit, thereby improving the energy efficiency.

Most of conventional compressors are double-cylinder compressors. The conventional control method of changing a double-cylinder compressor comprises: selecting, by a control device, the best operation frequency and working volume according to an operation capacity requirement and an optimal capacity curve of the current air conditioning unit. When the control device decides that the working volume needs to be changed according to the operation capacity of the air conditioning unit, the control device controls a valve body of the compressor to actuate, and simultaneously sends a control instruction for a switched cylinder to a driving controller, and the driving controller switches a corresponding control program after receiving the instruction.

SUMMARY OF THE INVENTION

According to some embodiments of the present disclosure, there is provided a control method of a compressor, comprising: deciding whether a current working volume state of the compressor is matched with a control instruction after the compressor completes a change to a working volume according to the control instruction; determining that the compressor operates normally in a case where the current working volume state of the compressor is matched with the control instruction; and determining that the compressor operates in fault in a case where the current working volume state of the compressor is not matched with the control instruction.

According to some other embodiments of the present disclosure, there is provided a refrigerant circulation system comprising a compressor and a control device, wherein the control device controls the compressor by performing the above-described control method of the compressor.

BRIEF DESCRIPTION OF THE DRAWINGS

The above and other objectives, features and advantages of the present disclosure will become more apparent from the following description of the embodiments thereof with reference to the accompanying drawings, in which.

DETAILED DESCRIPTION OF THE INVENTION

The present disclosure is described below based on embodiments, and it will be understood by those of ordinary skill in the art that the accompanying drawings provided herein are for illustrative purposes and are not necessarily drawn to scale.

Unless the context clearly requires otherwise, throughout the description and the claims, the words "comprise", "include", and the like are to be construed in an inclusive sense as opposed to an exclusive or exhaustive sense; that is, what is meant is "including but not limited to".

In the description of the present disclosure, it is to be understood that the terms "first", "second", and the like are used for descriptive purposes only and are not to be construed as indicating or implying relative importance. In addition, in the description of the present disclosure, "a plurality" means two or more unless otherwise specified.

The inventors find that when using the above-described control method to control the compressor, if the valve body of the compressor is damaged due to some reason, the working volume of the compressor may be automatically changed when there is no requirement to change the working volume, or the working volume of the compressor is not successfully changed after the control device sends an instruction of changing the working volume of the compressor, so that the control program of the compressor is not matched with the working volume of the compressor, resulting in an unstable operation of the air conditioning unit and shutdown thereof in severe cases, which greatly reduces the operation reliability of the air conditioning unit, influences the user experience, and lowers the user satisfaction.

In view of the above, one of the objectives of the present disclosure is to provide a control method of a compressor and a refrigerant circulation system, so as to solve the problems of unstable operation, poor operation reliability, and even shutdown caused by the compressor operating in the state where the operation state thereof is not matched with the control instruction.

Figure 1:
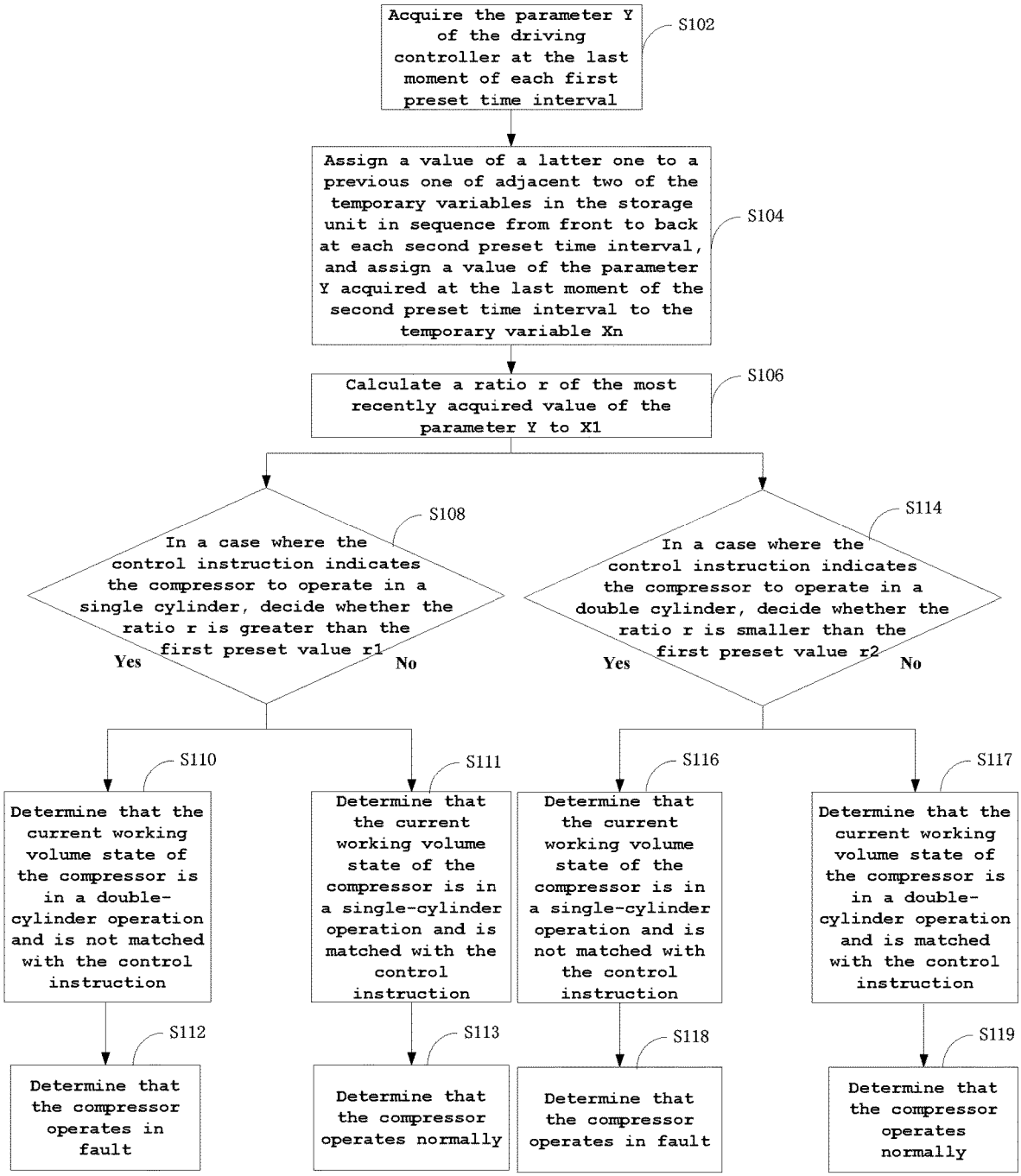
FIG. 1 is a flowchart illustrating a control method of a compressor according to some embodiments of the present disclosure.

As shown in FIG. 1, the present disclosure provides a control method of a compressor, wherein the control method of the compressor is used to control a compressor of a refrigerant circulation system and the compressor is in the refrigerant circulation system such as an air conditioner. A working volume of the compressor is able to be adjusted, and the working volume refers to a volume which is changing and involved in the working process of the compressor and does not refer to a maximum volume of the compressor. For example, the compressor is a frequency conversion compressor comprising a compressor body and a driving controller connected to the compressor body. When the compressor is a fixed-frequency compressor with a variable volume, the fixed-frequency compressor is able to be controlled using the control method in the present disclosure by installing a detection device and a controller on the fixed-frequency compressor.

The control method of the compressor in the present disclosure will be described in detail below by taking a compressor in an air conditioner as an example. The compressor comprises a compressor body and a driving controller, wherein a control unit is disposed on the compressor body. In some embodiments, the control unit comprises a control valve. In some embodiments, the control valve is an electromagnetic control valve, and the working volume of the compressor body involved in the working process of the compressor is able to be controlled by actuating the control valve. The control valve and the driving controller are respectively connected to a control device of the air conditioner, in some embodiments, the control device controls reversion and other states of the control valve so as to change the working volume of the compressor. In some embodiments, the control device sends a control instruction to the driving controller, and the driving controller controls the compressor body to perform different control programs according to the received control instruction. When a user sets the operation mode of the air conditioner to a mode with lower energy consumption, such as a low-load operation mode, by means of a controller of the air conditioner, the control device controls the control unit of the compressor to adjust the working volume of the compressor according to the user's setting, so as to reduce the minimum refrigerating capacity while improving the low-load energy efficiency. In this case, the control device controls the control valve according to the user's instruction to change the working volume of the compressor.

Figure 2:
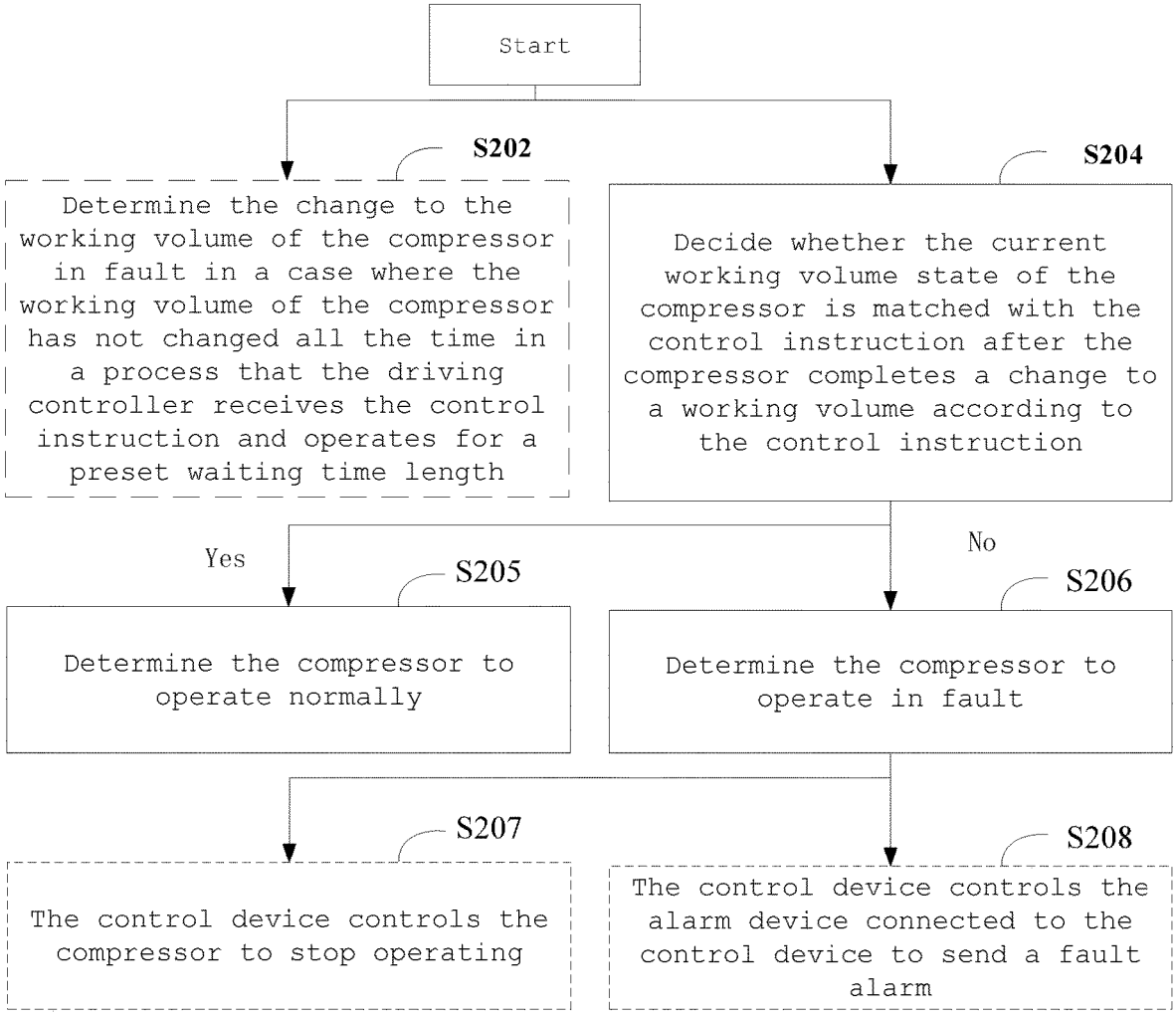
FIG. 2 is a flowchart illustrating a control method of a compressor according to some other embodiments of the present disclosure.

Further, in some embodiments, as shown in FIG. 2, in step S202, the change to the working volume of the compressor is determined in fault in a case where no change to the working volume of the compressor occurs throughout a process, during which the driving controller receives the control instruction and operates for a preset waiting time length. The reason why the working volume change of the compressor is in fault may be due to the fact that the control valve has not been actuated, or that the control valve has been actuated, but the working volume of the compressor has not been changed due to e.g. jamming. At this time, for example, the control device controls an alarm device connected thereto to give a fault alarm about the failure of the volume change, and particularly, a fault alarm about the failure of switching the cylinders of the compressor may be given to alarm the related technician or user to check the compressor and the control valve to determine whether or not damage occurs thereto. If the control valve is actuated to make the working volume of the compressor changed at any moment in the process that the driving controller receives the control instruction of the control device and operates for the preset waiting time length, the operation state of the compressor is decided.

Specifically, in some embodiments, in step S204, whether the current working volume state of the compressor is matched with the control instruction is decided after the compressor completes a change to a working volume according to the control instruction, and if so, in step S205, the compressor is determined to operate normally; and if not, in step S206, the compressor is determined to operate in fault. The control device performs at least one of the following operations in a case where the compressor operates in fault: in step S207, controlling the compressor to stop operating by controlling the driving controller; or in step S208, controlling the alarm device connected to the control device to send a fault alarm. If the compressor operates in fault, this shows that the control valve is in fault, and the alarm device sends a fault alarm so that related operators should perform related detection and maintenance on the control valve. In addition, since in the period from the moment that the control instruction is send from the control device to the moment that the working volume change of the compressor is completed, it surely occurs that the current working volume of the compressor is not matched with the control instruction. Therefore, the control device does not perform the control method and does not decide the operation state of the compressor from the moment that the driving controller receives the control instruction to the moment that the compressor completes the change to the working volume. For example, the method of deciding whether the working volume of the compressor is changed comprises making decision by means of sudden increase or decrease of at least one of current, voltage or frequency of the compressor to determine that the volume of the compressor is changed. Alternatively, it is also possible to decide the change of the working volume of the compressor by means of sudden increase or decrease of the difference between a discharge pressure and a suction pressure of the compressor. If none of the parameters detected by the method is changed in the detection, the working volume of the compressor is showed unchanged.

In some embodiments, the compressor is provided with a plurality of cylinders and a control valve connected with the plurality of cylinders. In some embodiments, the compressor is provided with two cylinders, and the control valve change the working volume of the compressor by controlling the number of cylinders in operating among the two cylinders, that is, single-cylinder operation or double-cylinder operation of the compressor is able to be realized by controlling the control valve. In order to accurately decide whether the current working volume state of the compressor is matched with the control instruction, the control method in the present disclosure comprises:

acquiring a parameter Y of the driving controller at a first preset time interval, storing the acquired parameter Y at a second preset time interval, and deciding whether the current working volume state of the compressor is matched with the control instruction according to the parameter Y. In some embodiments, the first preset time interval is shorter than the second preset time interval, so that the acquisition is performed many times, and the acquired parameter Y will also be used in other control processes, to further improve reliability of the control.

Each first preset time interval is an acquisition period and the parameter Y of the driving controller is acquired once within an acquisition period, wherein the parameter of the driving controller comprises at least one of current, voltage or power of the driving controller. The number of the acquisition periods is prestored in the control device, and if the number of the acquisition periods is too small, the stability and the reliability of the control process will not be ensured, and it will not be well decided whether the current working volume state of the compressor is matched with the control instruction. If the number of the acquisition periods is too large, resources are wasted on one hand, and on the other hand, the compressor may be caused to operate in a fault state, which influences the user experience and at the same time damages the compressor. Thus, for example, the number of the acquisition periods is 4.

The driving controller comprises a storage unit, and the storage unit stores a plurality of temporary variables X1, X2, . . . , Xn arranged in sequence with an initial value of zero, wherein the number of the temporary variables is set correspondingly according to the number of the acquisition periods. For example, the temporary variables include X1, X2 and X3 because the number of the acquisition periods is 4. As shown in FIG. 1, further, the acquiring the parameter Y of the driving controller at a first preset time interval, storing the acquired parameter Y at a second preset time interval comprises:

in step S102, acquiring the parameter Y of the driving controller at the last moment of each first preset time interval; and in step S104, assigning a value of a following one to a preceding one of adjacent two of the temporary variables in the storage unit in a chronological order from front to back at each second preset time interval, and assigning a value of the parameter Y acquired at the last moment of the second preset time interval to the temporary variable Xn, wherein the second preset time interval is an integer multiple of the first preset time interval, and in some embodiments, the first preset time interval is equal to the second preset time interval. In some embodiments, in the first acquisition period, the value Y1 of the acquired parameter Y is assigned to X3, then X1=0, X2=0, and X3=Y1 in the storage unit; in the second acquisition period, the value Y2 of the acquired parameter Y is assigned to X3, the value of X3 is assigned to X2, then X1=0, X2=Y1, and X3=Y2 in the storage unit; in the third acquisition period, the value Y3 of the acquired parameter Y is assigned to X3, the value of X3 is assigned to X2, the value of X2 is assigned to X1, then X1=Y1, X2=Y2, and X3=Y3 in the storage unit. In the fourth acquisition period, a value Y4 of the parameter Y is acquired.

Furthermore, the deciding whether the current working volume state of the compressor is matched with the control instruction according to the parameter comprises:

in step S106, calculating a ratio r of the most recently acquired value of the parameter Y to X1, and deciding whether the current working volume state of the compressor is matched with the control instruction according to a relationship between the ratio r and a preset value. Taking the above embodiment as an example, r=Y4/X1. It should be noted here that X1 should not be 0 when the ratio calculated, so as to ensure the reliability of the ratio calculation and further ensure the method to be implemented. The initial value of Xn being set to 0 will ensure that the parameter Y is stored at least 4 times to ensure the reliability and the integrity of the control method.

In some embodiments, the preset value comprises a first preset value r1 and a second preset value r2 depending on a different number of compressor cylinders serving as the current working volume of the compressor in the control instruction. The specific values of the first preset value r1 and the second preset value r2 vary with different capacities of the compressor, and the specific determination process thereof is able to be obtained through empirical values or a plurality of experiments. In a case where the control instruction indicates the compressor to operate in a single cylinder, whether the current working volume state of the compressor is matched with the control instruction is decided according to the relationship between the ratio r and the first preset value r1, and a deciding method comprises:

in step S108, deciding whether the ratio r is greater than the first preset value r1;

in step S110, determining that the current working volume state of the compressor is in a double-cylinder operation and is not matched with the control instruction in a case where the ratio r is greater than the first preset value r1; in step S112, determining that the compressor operates in fault;

in step S111, determining that the current working volume state of the compressor is in a single-cylinder operation and is matched with the control instruction in a case where the ratio r is not greater than the first preset value r1; and in step S113, determining that the compressor operates normally.

In a case where the control instruction indicates the compressor to operate in double cylinders, whether the current working volume state of the compressor is matched with the control instruction is decided according to the relationship between the ratio r and the second preset value r2, and a deciding method comprises:

in step S114, deciding whether the ratio r is smaller than the second preset value r2;

in step S116, determining that the current working volume state of the compressor is in a single-cylinder operation and is not matched with the control instruction in a case where the ratio r is smaller than the second preset value r2; in step S118, determining that the compressor operates in fault;

in step S117, determining that the current working volume state of the compressor is in a double-cylinder operation and is matched with the control instruction in a case where the ratio r is not smaller than the second preset value r2 and in step S119, determining that the compressor operates normally.

The first preset value r1 is greater than the second preset value r2. In some embodiments, the first preset value r1 ranges from 1.3 to 1.6 and the second preset value r2 ranges from 0.6 to 0.8. It should be noted here that the ranges of the first preset value r1 and the second preset value r2 of the compressors with different variable volumes are different.

Figure 3:
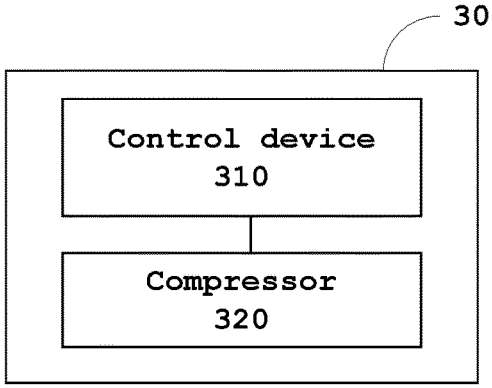
FIG. 3 is a schematic diagram of a refrigerant circulation system according to some embodiments of the present disclosure.

As shown in FIG. 3, the present disclosure also provides a refrigerant circulation system 30 comprising a control device 310 and a compressor 320, wherein the refrigerant circulation system 30 controls the compressor 320 by the control method so as to avoid the problem that the cylinders of the compressor are mistakenly switched or are not switched due to the invalidation of the control valve of the compressor, which causes unstable control processes of the refrigerant circulation system and various protection states, and results in the low operation reliability of the refrigerant circulation system.

It is easily understood by those skilled in the art that the above solutions are able to be freely combined and superimposed without conflict.

With the aid of the control method of the compressor and the refrigerant circulation system controlled by the control method in the present disclosure, it is able to decide whether the current working volume state of the compressor is matched with the control instruction, and timely processing is able to be made according to the decision, which improves the stability and reliability of the compressor in operation, and further improves the reliability of the refrigerant circulation system.

With the control method of the compressor in the present disclosure, instability and fault protection of the compressor in operation, caused by the failure or invalidation of the control valve of the compressor, is effectively avoided.

The above are merely embodiments of the present disclosure and are not intended to limit the present disclosure, and various modifications and changes may be made to the present disclosure by those skilled in the art. Any modification, equivalent replacement, improvement and the like made within the spirit and principle of the present disclosure shall be included in the protection scope of the present disclosure.

What is claimed is:

1. A control method of a compressor, comprising:

deciding whether a current state of a working volume of the compressor is matched with a control instruction after the compressor completes a change to the working volume according to the control instruction;

determining that the compressor operates normally in a case where the current state of the working volume of the compressor is matched with the control instruction; and determining that the compressor operates in fault in a case where the current state of the working volume of the compressor is not matched with the control instruction, wherein the compressor has a plurality of cylinders and a control unit connected to the plurality of cylinders, wherein the control unit changes the working volume of the compressor by means of changing a number of cylinders operating among the plurality of cylinders, the compressor comprises two cylinders, and the control unit comprises a control valve.

2. The control method of the compressor according to claim 1, wherein the compressor comprises a driving controller, and the driving controller is connected to a control device that sends the control instruction, and the control device performs at least one of the following operations in a case where the compressor operates in fault:

controlling the compressor to stop operating by controlling the driving controller; or controlling an alarm device connected to the control device to send a fault alarm.

3. A refrigerant circulation system, comprising a compressor and a control device, wherein the control device controls the compressor by performing the control method of the compressor according to claim 1.

4. The control method of the compressor according to claim 1, wherein the compressor comprises a compressor body and a driving controller connected to the compressor body, and deciding whether the current state of the working volume of the compressor is matched with the control instruction comprises:

acquiring a parameter Y of the driving controller at a first preset time interval, storing the acquired parameter Y at a second preset time interval, and deciding whether the current state of the working volume of the compressor is matched with the control instruction according to the parameter Y.

5. A control method of a compressor, comprising:

deciding whether a current state of a working volume of the compressor is matched with a control instruction after the compressor completes a change to the working volume according to the control instruction;

determining that the compressor operates normally in a case where the current state of the working volume of the compressor is matched with the control instruction, and determining that the compressor operates in fault in a case cohere the current state of the working volume of the compressor is not matched with the control instruction, wherein the compressor comprises a compressor body and a driving controller connected to the compressor body, and the driving controller is connected to a control device that sends the control instruction, the control method further comprising:

determining, by the control device, that the change to the working volume of the compressor is in fault, in a case where no change to the working volume of the compressor occurs throughout a process, during which the driving controller receives the control instruction and operates for a preset waiting time length.

6. The control method of the compressor according to claim 5, wherein the control device does not perform the control method and does not decide the operation state of the compressor from the moment that the driving controller receives the control instruction to the moment that the compressor completes the change to the working volume.

7. The control method of the compressor according to claim 5, wherein the compressor comprises a compressor body and a driving controller connected to the compressor body, and deciding whether the current state of the working volume of the compressor is matched with the control instruction comprises:

acquiring a parameter Y of the driving controller at a first preset time interval, storing the acquired parameter Y at a second preset time interval, and deciding whether the current state of the working volume of the compressor is matched with the control instruction according to the parameter Y.

8. The control method of the compressor according to claim 5, wherein the compressor comprises a driving controller, and the driving controller is connected to a control device that sends the control instruction, and the control device performs at least one of the following operations in a case where the compressor operates in fault:

controlling the compressor to stop operating by controlling the driving controller; or controlling an alarm device connected to the control device to send a fault alarm.

9. A refrigerant circulation system, comprising a compressor and a control device, wherein the control device controls the compressor by performing the control method of the compressor according to claim 5.

10. A control method of a compressor, comprising:

deciding whether a current state of a working volume of the compressor is matched with a control instruction after the compressor completes a change to the working volume according to the control instruction;

determining that the compressor operates normally in a case where the current state of the working volume of the compressor is matched with the control instruction; and determining that the compressor operates in fault in a case where the current state of the working volume of the compressor is not matched with the control instruction, wherein the compressor comprises a compressor body and a driving controller connected to the compressor both, and deciding whether the current state of the working volume of the compressor is matched with the control instruction comprises:

acquiring a parameter Y of the driving controller at a first preset time interval, storing the acquired parameter Y at a second preset time interval, and deciding whether the current state of the working volume of the compressor is matched with the control instruction according to the parameter Y, wherein the parameter Y of the driving controller comprises at least one of a current, a voltage or a power of the driving controller.

11. The control method of the compressor according to claim 10, wherein the driving controller is connected to a control device that sends the control instruction, the driving controller comprises a storage unit, and the storage unit stores a plurality of temporary variables X1, X2, . . . , Xn arranged in sequence with an initial value of zero and acquiring the parameter Y of the driving controller at a first preset time interval, storing the acquired parameter Y at a second preset time interval comprises:

acquiring the parameter Y of the driving controller at the last moment of each first preset time interval; and assigning a value of a following one to a preceding one of an adjacent two of the temporary variables in the storage unit in a chronological order from front to back at each second preset time interval, and assigning a value of the parameter Y acquired at the last moment of the second preset time interval to the temporary variable Xn, wherein the second preset time interval is an integer multiple of the first preset time interval.

12. The control method of the compressor according to claim 11, wherein deciding whether the current state of the working volume of the compressor is matched with the control instruction according to the parameter comprises:

calculating a ratio r of the most recently acquired value of the parameter Y to X1, and deciding whether the current state of the working volume of the compressor is matched with the control instruction according to a relationship between the ratio r and a preset value.

13. The control method of the compressor according to claim 12, wherein the preset value comprises a first preset value r1, and the compressor comprises two cylinders, and in a case where the control instruction indicates the compressor to operate in a single cylinder, deciding whether the current state of the working volume of the compressor is matched with the control instruction according to the relationship between the ratio r and the preset value comprises:

deciding whether the ratio r is greater than the first preset value r1;

determining that the current state of the working volume of the compressor is in a double-cylinder operation and is not matched with the control instruction in a case where the ratio r is greater than the first preset value r1; and determining that the current state of the working volume of the compressor is in a single-cylinder operation and is matched with the control instruction in a case where the ratio r is not greater than the first preset value r1.

14. The control method of the compressor according to claim 13, wherein the preset value further comprises a second preset value r2, and in a case where the control instruction indicates the compressor to operate in double cylinders, deciding whether the current state of the working volume of the compressor is matched with the control instruction according to the relationship between the ratio r and the preset value comprises:

deciding whether the ratio r is smaller than the second preset value r2;

determining that the current state of the working volume of the compressor is in a single-cylinder operation and is not matched with the control instruction in a case where the ratio r is smaller than the second preset value r2; and determining that the current state of the working volume of the compressor is in a double-cylinder operation and is matched with the control instruction in a case where the ratio r is not smaller than the second preset value r2.

15. The control method of the compressor according to claim 14, wherein the relationship between the first preset value r1 and the second preset value r2 is that r1 is greater than r2.

16. A refrigerant circulation system, comprising a compressor and a control device, wherein the control device controls the compressor by performing the control method of the compressor according to claim 10.

17. A refrigerant circulation system, comprising a compressor and a control device, wherein the control device controls the compressor by performing the control method of the compressor according to claim 11.

18. A refrigerant circulation system, comprising a compressor and a control device, wherein the control device controls the compressor by performing the control method of the compressor according to claim 12.

19. A refrigerant circulation system, comprising a compressor and a control device, wherein the control device controls the compressor by performing the control method of the compressor according to claim 13.

20. A refrigerant circulation system, comprising a compressor and a control device, wherein the control device controls the compressor by performing the control method of the compressor according to claim 14.

* * * * *